US011605901B2

(12) United States Patent
Tang et al.

(10) Patent No.: US 11,605,901 B2
(45) Date of Patent: Mar. 14, 2023

(54) BEAM RECONSTRUCTION METHOD, ANTENNA, AND MICROWAVE DEVICE

(71) Applicant: HUAWEI TECHNOLOGIES CO., LTD., Shenzhen (CN)

(72) Inventors: Xianfeng Tang, Shenzhen (CN); Yu Liu, Chengdu (CN); Kun Li, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 104 days.

(21) Appl. No.: 17/150,320

(22) Filed: Jan. 15, 2021

(65) Prior Publication Data

US 2021/0135358 A1 May 6, 2021

Related U.S. Application Data

(63) Continuation of application No. PCT/CN2019/080933, filed on Apr. 2, 2019.

(30) Foreign Application Priority Data

Jul. 19, 2018 (CN) ..... 201810793800.1

(51) Int. Cl.
*H01Q 19/13* (2006.01)
*H01Q 19/08* (2006.01)
(Continued)

(52) U.S. Cl.
CPC ..... *H01Q 19/132* (2013.01); *H01Q 1/246* (2013.01); *H01Q 3/46* (2013.01); *H01Q 19/08* (2013.01); *H01Q 19/19* (2013.01)

(58) Field of Classification Search
CPC ..... H01Q 1/246; H01Q 3/44; H01Q 3/46; H01Q 15/0086; H01Q 15/08; H01Q 19/06;
(Continued)

(56) References Cited

U.S. PATENT DOCUMENTS 9,450,310 B2 9/2016 Bily et al.
2017/0271762 A1 9/2017 Ko et al.
(Continued)

FOREIGN PATENT DOCUMENTS

CN 102904043 A 1/2013
CN 106099377 A 11/2016
(Continued)

OTHER PUBLICATIONS

Matthias Maasch et al., Voltage-Tunable Artificial Gradient-Index Lens Based on a Liquid Crystal Loaded Fishnet Metamaterial. IEEE Antennas and Wireless Propagation Letters, vol. 13, 2014, 4 pages.
(Continued)

*Primary Examiner* — Robert Karacsony
(74) *Attorney, Agent, or Firm* — Hauptman Ham, LLP

(57) ABSTRACT

A beam reconstruction method includes: generating or receiving a radio frequency signal, determining a to-be-adjusted beam angle, loading a voltage bias value on each liquid crystal metasurface array unit among a plurality of liquid crystal metasurface array units in a liquid crystal metasurface array based on the beam angle, and either emitting the generated radio frequency signal transmitted through the liquid crystal metasurface array or directing the received radio frequency signal through the liquid crystal metasurface array to a feed of an antenna. A lateral offset of a feed phase center is generated based on the voltage bias value after the radio frequency signal is transmitted through the liquid crystal metasurface array.

20 Claims, 10 Drawing Sheets

(51) Int. Cl.
*H01Q 1/24* (2006.01)
*H01Q 3/46* (2006.01)
*H01Q 19/19* (2006.01)

(58) Field of Classification Search
CPC ..... H01Q 19/08; H01Q 19/13; H01Q 19/132; H01Q 19/18; H01Q 19/19
See application file for complete search history.

(56) References Cited

U.S. PATENT DOCUMENTS

| | | | |
|---|---|---|---|
| 2017/0329127 | A1 | 11/2017 | LIU et al. |
| 2018/0109002 | A1 | 4/2018 | Foo |

FOREIGN PATENT DOCUMENTS

| | | | |
|---|---|---|---|
| CN | 106450765 | A | 2/2017 |
| CN | 107425279 | A | 12/2017 |
| FR | 2858469 | A1 | 2/2005 |
| GN | 104966905 | B | 5/2018 |

OTHER PUBLICATIONS

Chinese Office Action issued in corresponding Chinese Application No. 201810793800.1, dated Nov. 20, 2020, pp. 1-12.
International Search Report issued in corresponding International Application No. PCT/CN2019/080933, dated Jun. 13, 2019, p. 1-10.
European Search Report issued in corresponding European Patent Application No. 19837191.6, dated Jul. 9, 2021, pp. 1-8, Munich, Germany.

BEAM RECONSTRUCTION METHOD, ANTENNA, AND MICROWAVE DEVICE

CROSS-REFERENCE TO RELATED APPLICATIONS

This application is a continuation of International Patent Application No. PCT/CN2019/080933, filed on Apr. 2, 2019, which claims priority to Chinese Patent Application No. 201810793800.1, filed on Jul. 19, 2018. The disclosures of the aforementioned applications are hereby incorporated by reference in their entireties.

TECHNICAL FIELD

This application relates to the communications field, and in particular, to a beam reconstruction method, an antenna, a microwave device, and a network system.

BACKGROUND

Microwave backhaul, featuring fast deployment and flexible installation, is one of solutions for mobile backhaul. With development of mobile and fixed networks, common-band (6 GHz to 42 GHz) microwave backhaul faces the following challenges: With large-scale deployment of 4G networks and evolution to 5G networks, a bandwidth requirement continuously increases. For example, a macro base station requires a gigabit (Gbps)-level bandwidth. More frequency resources are consumed for an increase in bandwidth. This causes a gradual shortage of spectrum resources in common bands (6 GHz to 42 GHz), and it is difficult to obtain the frequencies and meet the bandwidth requirement. To greatly increase the bandwidth and reduce the occupation of spectrum resources in common bands, E-band (71 GHz to 76 GHz/81 GHz to 86 GHz) microwave with 10 GHz spectrum resources will become a solution to the bandwidth and spectrum resources.

The E-band microwave can be applied to long-distance backhaul of macro base stations (for example, a backhaul distance of more than 7 km). However, when the E-band microwave is applied to the long-distance backhaul of macro base stations, the following problems exist: Long-distance E-band requires that an antenna has high gain. A high-gain transmitting antenna has a sharp beam, and the sharp beam makes the antenna sensitive to shaking (for example, if the antenna is installed on a tower, the antenna is sensitive to shaking of the tower). Consequently, gain of a receiving antenna decreases, and a microwave transmission distance is affected.

Therefore, how to design a beam reconfigurable antenna and enhance a capability of resisting shaking of the antenna becomes a technical problem to be resolved.

SUMMARY

In view of this, this application provides a beam reconstruction method, an antenna, a microwave device, and a network system, to resolve a problem that the antenna is sensitive to shaking.

According to a first aspect, this application provides an antenna. The antenna includes a feed, a liquid crystal metasurface array, a liquid crystal bias control circuit, and a beam transformation structure. The liquid crystal metasurface array includes a plurality of liquid crystal metasurface array units, for example, M×N liquid crystal metasurface array units, where M and N are positive integers greater than or equal to 2. The feed may receive a radio frequency signal from an outdoor unit or a radio frequency module of a microwave device, and radiate the received radio frequency signal to the outside. The liquid crystal bias control circuit is configured to: determine a to-be-adjusted beam angle, and load a voltage bias value on each liquid crystal metasurface array unit in the liquid crystal metasurface array based on the beam angle. The liquid crystal metasurface array is configured to: transmit the radio frequency signal, and generate a lateral offset of a feed phase center based on the voltage bias value. The beam transformation structure is configured to emit the radio frequency signal transmitted through the liquid crystal metasurface array. Some embodiments implement a beam reconfigurable antenna with low costs and low complexity, which may be applied to a microwave device at a transmitting end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the liquid crystal bias control circuit changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, the liquid crystal bias control circuit changes a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the liquid crystal bias control circuit is further configured to determine the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

In a possible implementation, the liquid crystal bias control circuit is further configured to determine the dielectric constant of each liquid crystal metasurface array unit based on the lateral offset of the feed phase center. A correspondence between the lateral offset of the feed phase center and the dielectric constant of each liquid crystal metasurface array unit may be calculated and stored in advance, thereby improving beam alignment efficiency.

In a possible implementation, the liquid crystal bias control circuit is further configured to determine each voltage bias value based on the dielectric constant of each liquid crystal metasurface array unit. The voltage bias value corresponding to the liquid crystal dielectric constant may be determined by engineering testing or table lookup.

In a possible implementation, the beam transformation structure may include a primary reflector and a secondary reflector, the feed and the liquid crystal metasurface array are located between the primary reflector and the secondary reflector, and the liquid crystal metasurface array is located between the feed and the secondary reflector. A beam reconfigurable Cassegrain antenna is implemented by placing the feed and liquid crystal metasurface array between the primary reflector and the secondary reflector.

In a possible implementation, the beam transformation structure may include a lens, and the liquid crystal metasurface array is located between the feed and the lens. A beam reconfigurable lens antenna is implemented by placing the liquid crystal metasurface array between the feed and the lens.

According to a second aspect, this application provides an antenna. The antenna includes a feed, a liquid crystal metasurface array, a liquid crystal bias control circuit, and a beam transformation structure. The liquid crystal metasurface array includes a plurality of liquid crystal metasurface array units, for example, M×N liquid crystal metasurface array units, where M and N are positive integers greater than or equal to 2. The beam transformation structure receives a radio frequency signal that is sent at a transmitting end and that is propagated through the air. The liquid crystal bias control circuit is configured to: determine a to-be-adjusted beam angle, and load a voltage bias value on each liquid crystal metasurface array unit in the liquid crystal metasurface array based on the to-be-adjusted beam angle. The liquid crystal metasurface array is configured to: transmit the radio frequency signal, and generate a lateral offset of a feed phase center based on the voltage bias value. The feed is configured to receive the radio frequency signal transmitted through the liquid crystal metasurface array. At least one embodiment implements a beam reconfigurable antenna with low costs and low complexity, which may be applied to a microwave device at a receive end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the liquid crystal bias control circuit changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, the liquid crystal bias control circuit changes a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the liquid crystal bias control circuit is further configured to determine the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

In a possible implementation, the liquid crystal bias control circuit is further configured to determine the dielectric constant of each liquid crystal metasurface array unit based on the lateral offset of the feed phase center. A correspondence between the lateral offset of the feed phase center and the dielectric constant of each liquid crystal metasurface array unit may be calculated and stored in advance, thereby improving beam alignment efficiency.

In a possible implementation, the liquid crystal bias control circuit is further configured to determine each voltage bias value based on the dielectric constant of each liquid crystal metasurface array unit. The voltage bias value corresponding to the liquid crystal dielectric constant may be determined by engineering testing or table lookup.

In a possible implementation, the beam transformation structure may include a primary reflector and a secondary reflector, the feed and the liquid crystal metasurface array are located between the primary reflector and the secondary reflector, and the liquid crystal metasurface array is located between the feed and the secondary reflector. A beam reconfigurable Cassegrain antenna is implemented by placing the feed and liquid crystal metasurface array between the primary reflector and the secondary reflector.

In a possible implementation, the beam transformation structure may include a lens, and the liquid crystal metasurface array is located between the feed and the lens. A beam reconfigurable lens antenna is implemented by placing the liquid crystal metasurface array between the feed and the lens.

According to a third aspect, this application provides a beam reconstruction method. The method may be performed by an antenna at a transmitting end, and includes: generating a radio frequency signal; determining a to-be-adjusted beam angle; loading a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and emitting the radio frequency signal transmitted through the liquid crystal metasurface array. At least one embodiment implements a beam reconfigurable method with low costs and low complexity, which may be applied to a microwave device at the transmitting end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the method further includes: changing, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, before changing the transmission phase, the method further includes: changing a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the method further includes: determining the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

In a possible implementation, the method further includes: determining the dielectric constant of each liquid crystal metasurface array unit based on the lateral offset of the feed phase center. A correspondence between the lateral offset of the feed phase center and the dielectric constant of each liquid crystal metasurface array unit may be calculated and stored in advance, thereby improving beam alignment efficiency.

In a possible implementation, the method further includes: determining each voltage bias value based on the dielectric constant of each liquid crystal metasurface array unit. The voltage bias value corresponding to the liquid crystal dielectric constant may be determined by engineering testing or table lookup.

According to a fourth aspect, this application provides a beam reconstruction method. The method may be performed by an antenna at a receive end, and includes: receiving a radio frequency signal; determining a to-be-adjusted beam angle; loading a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and receiving the radio frequency signal transmitted through the liquid crystal metasurface array. At least one embodiment implements a beam reconfigurable method with low costs and low complexity, which may be applied to a microwave device at the receive end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the method further includes: changing, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, before changing the transmission phase, the method further includes: changing a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the method further includes: determining the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

In a possible implementation, the method further includes: determining the dielectric constant of each liquid crystal metasurface array unit based on the lateral offset of the feed phase center. A correspondence between the lateral offset of the feed phase center and the dielectric constant of each liquid crystal metasurface array unit may be calculated and stored in advance, thereby improving beam alignment efficiency.

In a possible implementation, the method further includes: determining each voltage bias value based on the dielectric constant of each liquid crystal metasurface array unit. The voltage bias value corresponding to the liquid crystal dielectric constant may be determined by engineering testing or table lookup.

According to a fifth aspect, this application provides a microwave device. The microwave device includes an indoor unit, an outdoor unit, and an antenna. The indoor unit is configured to convert a baseband digital signal into an intermediate frequency analog signal; the outdoor unit is configured to: receive the intermediate frequency analog signal, and convert the intermediate frequency analog signal into a radio frequency signal; and the antenna is configured to: receive the radio frequency signal; determine a to-be-adjusted beam angle; load a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and emit the radio frequency signal transmitted through the liquid crystal metasurface array. At least one embodiment implements a beam reconfigurable antenna with low costs and low complexity, which may be applied to a microwave device at a transmitting end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the antenna changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, the antenna changes a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the antenna is further configured to determine the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

According to a sixth aspect, this application provides a microwave device. The microwave device includes an indoor unit, an outdoor unit, and an antenna. The antenna is configured to: receive a radio frequency signal; determine a to-be-adjusted beam angle; load a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and emit the radio frequency signal transmitted through the liquid crystal metasurface array to the outdoor unit. The outdoor unit is configured to:

receive the radio frequency signal, and convert the radio frequency signal into an intermediate frequency analog signal. The indoor unit is configured to convert the intermediate frequency analog signal into a baseband signal. At least one embodiment implements a beam reconfigurable antenna with low costs and low complexity, which may be applied to a microwave device at a receive end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the antenna changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

In a possible implementation, the antenna changes a dielectric constant of each liquid crystal metasurface array unit based on the loaded voltage bias value. The liquid crystal dielectric constant is changed based on the voltage bias value, so that the transmission phase of the liquid crystal metasurface array unit is changed.

In a possible implementation, the antenna is further configured to determine the lateral offset of the feed phase center based on the to-be-adjusted beam angle. According to an antenna scanning principle, a relationship between a deflection angle of the antenna beam and the lateral offset of the feed phase center can be obtained. The deflection angle of the antenna beam is the same as the to-be-adjusted beam angle, but the directions are opposite.

According to a seventh aspect, this application provides a network system. The network system includes a first microwave device and a second microwave device. The first microwave device is configured to: convert a baseband digital signal into an intermediate frequency analog signal; convert the intermediate frequency analog signal into a radio frequency signal; determine a to-be-adjusted beam angle; load a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and emit the radio frequency signal transmitted through the liquid crystal metasurface array to the second microwave device. The second microwave device is configured to: receive the radio frequency signal from the first microwave device, and demodulate the received radio frequency signal. At least one embodiment implements a beam reconfigurable antenna with low costs and low complexity, which may be applied to a microwave device at a transmitting end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the antenna changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

According to an eighth aspect, this application provides a network system. The network system includes a first microwave device and a second microwave device. The first microwave device is configured to: modulate a baseband digital signal into a radio frequency signal, and transmit the radio frequency signal to the second microwave device. The second microwave device is configured to: receive the radio frequency signal from the first microwave device; determine a to-be-adjusted beam angle; load a voltage bias value on each liquid crystal metasurface array unit in a liquid crystal metasurface array based on the beam angle, where a lateral offset of a feed phase center is generated based on the voltage bias value after the radio frequency signal is transmitted through the liquid crystal metasurface array, the liquid crystal metasurface array includes M×N liquid crystal metasurface array units, and M and N are positive integers greater than or equal to 2; and convert the radio frequency signal transmitted through the liquid crystal metasurface array into an intermediate frequency analog signal, and convert the intermediate frequency analog signal into a baseband signal. At least one embodiment implements a beam reconfigurable antenna with low costs and low complexity, which may be applied to a microwave device at a receive end. When a beam direction is not aligned with an antenna at a receive end, the voltage bias value of the liquid crystal metasurface array unit may be adjusted, to implement reconfiguration of the feed phase center and reconfiguration of an antenna beam, thereby implementing beam alignment.

In a possible implementation, the antenna changes, based on the loaded voltage bias value, a transmission phase generated when the radio frequency signal is transmitted through each liquid crystal metasurface array unit. The transmission phase of the liquid crystal metasurface array unit is changed, so that the feed phase center is laterally offset, thereby implementing reconfiguration of an antenna beam.

Still another aspect of this application provides a non-transitory computer-readable storage medium. The non-transitory computer-readable storage medium stores an instruction, and when the instruction is run on an antenna or a microwave device, the antenna or the microwave device is enabled to perform the method according to the foregoing aspects.

Yet another aspect of this application provides an executable program product including an instruction. When the executable program product runs on an antenna or a microwave device, the antenna or the microwave device is enabled to perform the method according to the foregoing aspects.

BRIEF DESCRIPTION OF DRAWINGS

Aspects of various embodiments are best understood from the following detailed description when read with the accompanying figures.

DESCRIPTION OF EMBODIMENTS

The following describes some embodiments in detail with reference to the accompanying drawings.

Figure 1:
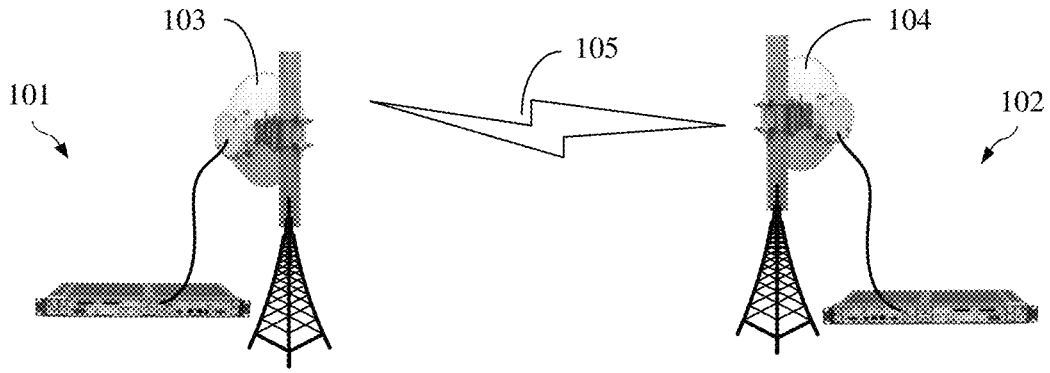
FIG. 1 is a schematic diagram of a microwave network architecture according to at least one embodiment.

First, a possible application scenario of some embodiments is described. FIG. 1 is a schematic diagram of a microwave network architecture according to at least one embodiment. As shown in FIG. 1, a beam reconfigurable antenna 103 or 104 (which may be referred to as an antenna for short) in accordance with at least one embodiment may be assembled in a microwave device 101 and a microwave device 102, and communication is performed through the antenna 103 or 104. For example, the microwave device 101 generates and transmits a beam 105 through the antenna 103, and the beam 105 is received by the antenna 104 of the microwave device 102 through spatial transmission over a specific distance. The beam herein may be formed by a radio frequency signal (an electromagnetic wave). The beam reconfigurable antenna is a pattern-reconfigurable antenna, that is, a maximum gain direction or direction of a beam may be flexibly changed. Therefore, when an antenna at a transmitting end and/or an antenna at a receiving end shake/shakes, and a beam cannot be aligned by the antenna at the receiving end for receiving, the beam reconfigurable antenna may adjust a beam direction, to re-implement alignment.

The antenna in at least one embodiment may include a feed, a liquid crystal metasurface array, a beam transformation structure (for example, a reflector or a lens), and the like. The following describes a working principle of the beam reconfigurable antenna in at least one embodiment. A beam emitted by the feed is transmitted through the liquid crystal metasurface array, a resonance characteristic of the liquid crystal metasurface array is used, and a liquid crystal dielectric constant is controlled by using a voltage bias value, to change a transmission phase of a liquid crystal metasurface array unit, and implement a lateral offset of a feed phase center, so that the antenna beam can be reconstructed. The lateral offset of the feed phase center (or the reconfigurable phase center) means that a lateral position of the feed phase center changes, for example, the phase center moves on a plane parallel to the feed aperture plane. The following describes the lateral offset of the feed phase center with reference to the accompanying drawings.

Figure 2A:
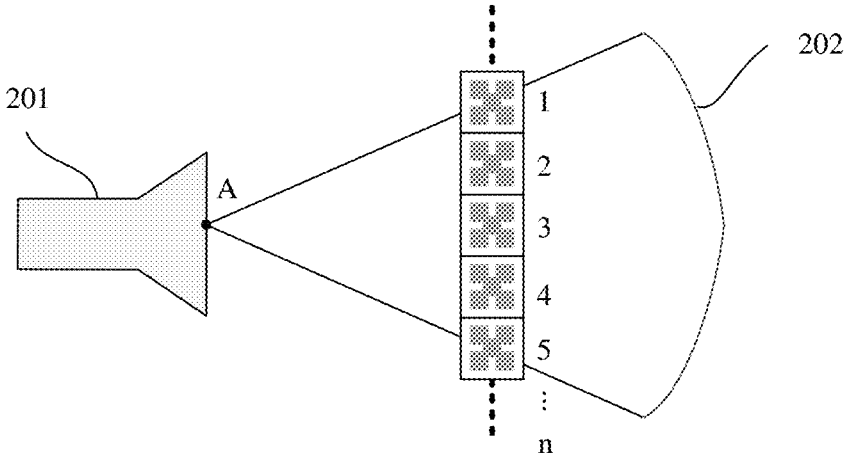
FIG. 2A is a diagram of an initial state of a feed phase center according to at least one embodiment.

FIG. 2A is a diagram of an initial state of a feed phase center according to at least one embodiment. As shown in FIG. 2A, after a beam radiated by a feed 201 is away from the feed for a specific distance, an equiphase surface 202 of the feed is approximately a sphere, and a sphere center of the sphere is an equivalent phase center (or a phase center) of the feed. The equivalent phase center is at point A, and total phases generated after a beam is transmitted through liquid crystal metasurface array units (or liquid crystal metasurface array elements) 1, 2, 3, 4, 5, . . . , n are $\varphi_{A1}+\varphi_1$, $\varphi_{A2}+\varphi_2$, $\varphi_{A3}+\varphi_3$, $\varphi_{A4}+\varphi_4$, $\varphi_{A5}+\varphi_5$, . . . , $\varphi_{An}+\varphi_n$ ($\varphi_{An}$ is a spatial phase generated from the point A to the unit n, and $\varphi_n$ is a transmission phase generated from the unit n).

Figure 2B:
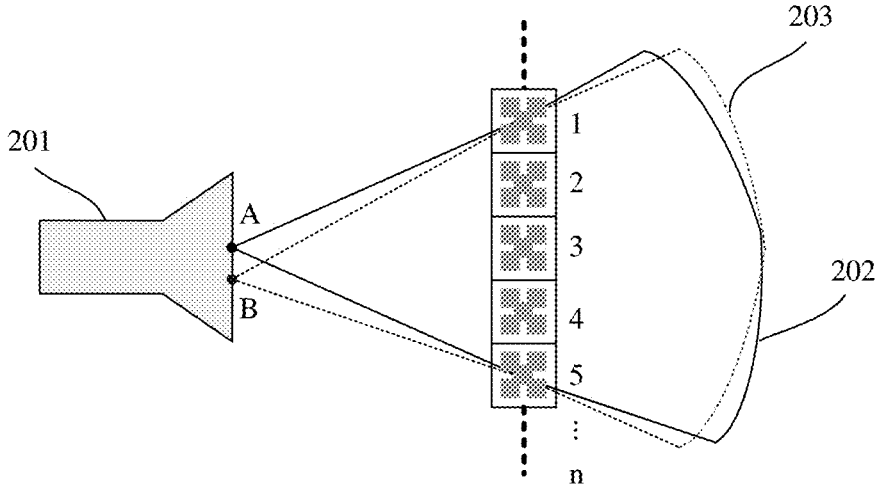
FIG. 2B is a diagram of a lateral offset state of a feed phase center according to at least one embodiment.

FIG. 2B is a diagram of a lateral offset state of a feed phase center according to at least one embodiment. After a liquid crystal bias voltage is changed, transmission phases of the liquid crystal metasurface array units 1, 2, 3, 4, 5, . . . , n are respectively increased by $\Delta_{\varphi 1}$, $\Delta_{\varphi 2}$, $\Delta_{\varphi 3}$, $\Delta_{\varphi 4}$, $\Delta\varphi_5$, . . . , and $\Delta\varphi_n$. In this case, the equivalent phase center is at a point B, and total phases generated after the beam is transmitted through the liquid crystal metasurface units 1, 2, 3, 4, 5, . . . , n are respectively $\varphi_{B1}+\varphi_1+\Delta\varphi_1$, $\varphi_{B2}+\varphi_2+\Delta\varphi_2$, $\varphi_{B3}+\varphi_3+\Delta\varphi_3$, $\varphi_{B4}+\varphi_4+\Delta\varphi_4$, $\varphi_{B5}+\varphi_5+\Delta\varphi_5$, . . . , and $\varphi_{Bn}+\varphi_n+\Delta\varphi_n$. After the equivalent phase center moves from the point A to the point B, the equiphase surface moves from 202 to 203, that is, $\varphi_{An}+\varphi_n=\varphi_{Bn}+\varphi_n+\Delta\varphi_n$. Therefore, $\varphi_{An}-\varphi_{Bn}=\Delta\varphi_n$ (n=1, 2, 3, 4, 5, . . . ).

Figure 3:
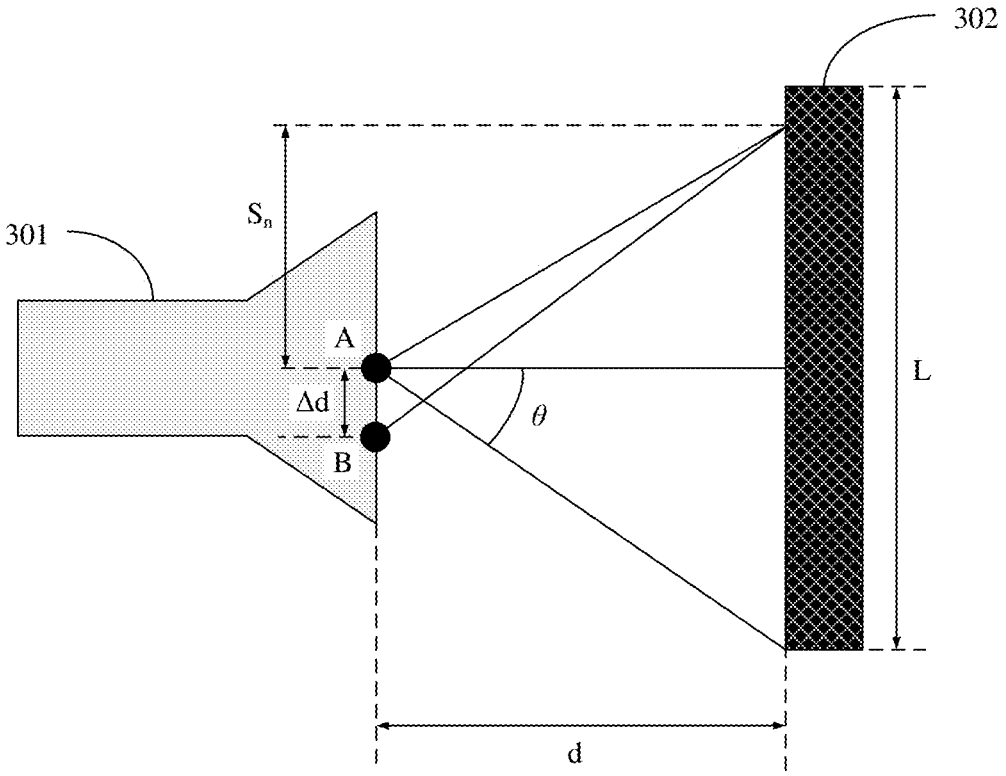
FIG. 3 is a location relationship diagram of a lateral offset state of a feed phase center according to at least one embodiment.

FIG. 3 is a location relationship diagram of a lateral offset state of a feed phase center according to at least one embodiment. As shown in FIG. 3, based on a position relationship between a feed 301 and a liquid crystal metasurface array 302, and the lateral offset state of the feed phase center, the following relationship may be deduced.

A distance (d) between a horn aperture surface of the feed and the liquid crystal metasurface array and a side length (L) of the liquid crystal metasurface array meet the following condition:

$$\tan\theta=(L/2)/d \quad (1), \text{ where}$$

θ is a half illuminating angle of the feed.

It can be learned from $\varphi_{Bn}-\varphi_{An}=\Delta\varphi_n$ (n=1, 2, 3, 4, 5, . . . ) that, a spatial phase change is equal to a transmission phase change $\varphi_n$ (n=1, 2, 3, 4, 5, . . . ) of the liquid crystal metasurface array unit:

$$k\sqrt{s_n^2+d^2}-k\sqrt{(s_n+\Delta d)^2+d^2}=\Delta\varphi_n \quad (2), \text{ where}$$

$S_n$ is a distance from the feed phase center A to the $n^{th}$ unit; $k=2\pi f/c$ is a quantity of waves in free space, f is a working frequency of an electromagnetic wave, and c is the speed of light; and Δd is the lateral offset of the feed phase center.

The following parameters are used as an example for quantitative analysis: the working frequency is 73.5 GHz, the half illuminating angle of the feed θ is 35 degrees, and a longitudinal spacing d between the horn aperture surface of the feed and the liquid crystal metasurface array is 6.5 mm. According to the foregoing parameters and with reference to formula (2), a transmission phase change $\Delta\varphi_n$ of each liquid crystal metasurface array unit may be obtained through simulation when phase centers of different feeds are laterally offset by Δd.

Figure 4:
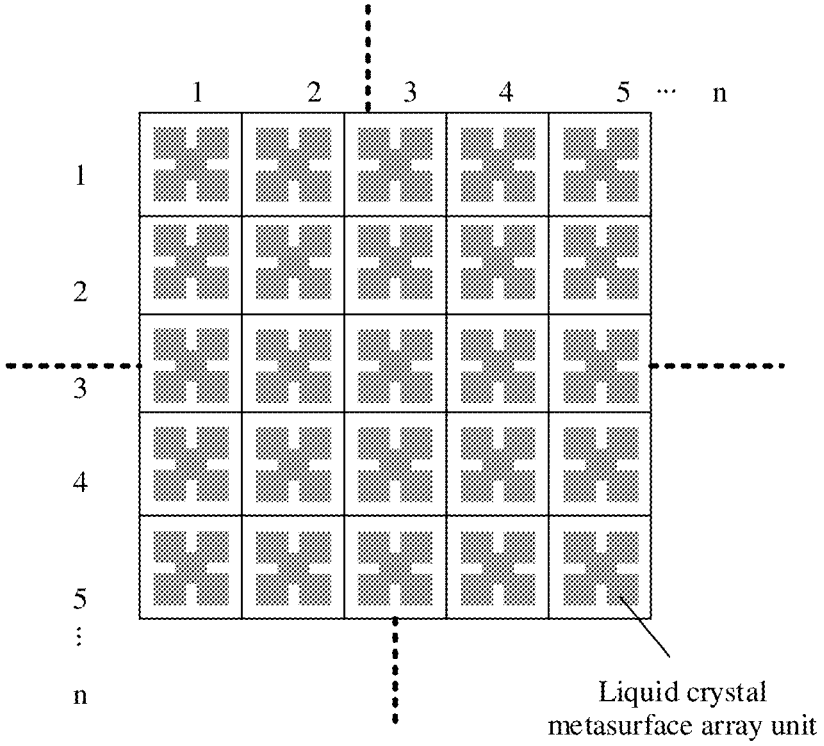
FIG. 4 is a schematic diagram of a liquid crystal metasurface array according to at least one embodiment.
Figure 5:
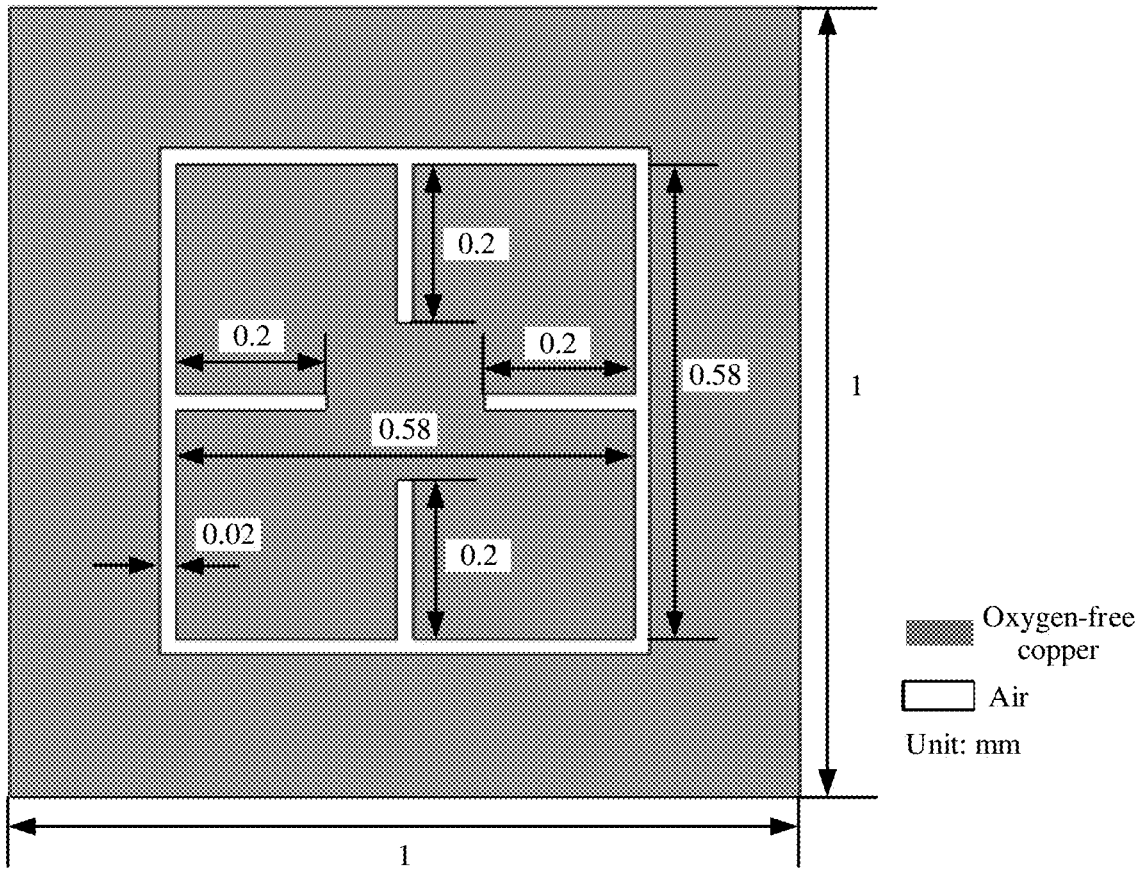
FIG. 5 is a structural parameter diagram of a liquid crystal metasurface array unit according to at least one embodiment.

The relationship between the liquid crystal dielectric constant and the transmission phase, and the relationship between the liquid crystal dielectric constant and the lateral offset of the phase center can be obtained through simulation after quantitative analysis. FIG. 4 is a schematic diagram of a liquid crystal metasurface array. The liquid crystal metasurface array may be of a planar structure, or may be of a curved surface structure. The liquid crystal metasurface array may include a liquid crystal layer, a metasurface layer, and a dielectric layer. The following parameters are used as an example for simulation:

(1) A size of a cross section of each liquid crystal metasurface array unit is 1 mm×1 mm;

(2) Liquid crystal layer: The liquid crystal layer is made of liquid crystal with a thickness of 0.1 mm, the relative dielectric constant is between 2.6 and 3.4, and the relative permeability is 1;

(3) Metasurface layer: The metasurface layer is made of oxygen-free copper with a thickness of 0.01 mm, and includes 9×9 liquid crystal metasurface array units (also referred to as metal resonance units). For detailed example parameters of each liquid crystal metasurface array unit, refer to FIG. 5; and (4) Dielectric layer: The dielectric layer is made of Rogers RT5880LZ with a thickness of 0.4 mm, the relative dielectric constant is 1.96, and the relative permeability is 1.

It is assumed that initial states of the liquid crystal metasurface array units are as follows. Dielectric constants of the liquid crystal metasurface array units are equal and each is 3. A simulation is performed based on the foregoing parameters of the liquid crystal metasurface array, to obtain a variation relationship between a transmission phase of a liquid crystal metasurface array unit and a frequency under different liquid crystal dielectric constants.

Figure 6:
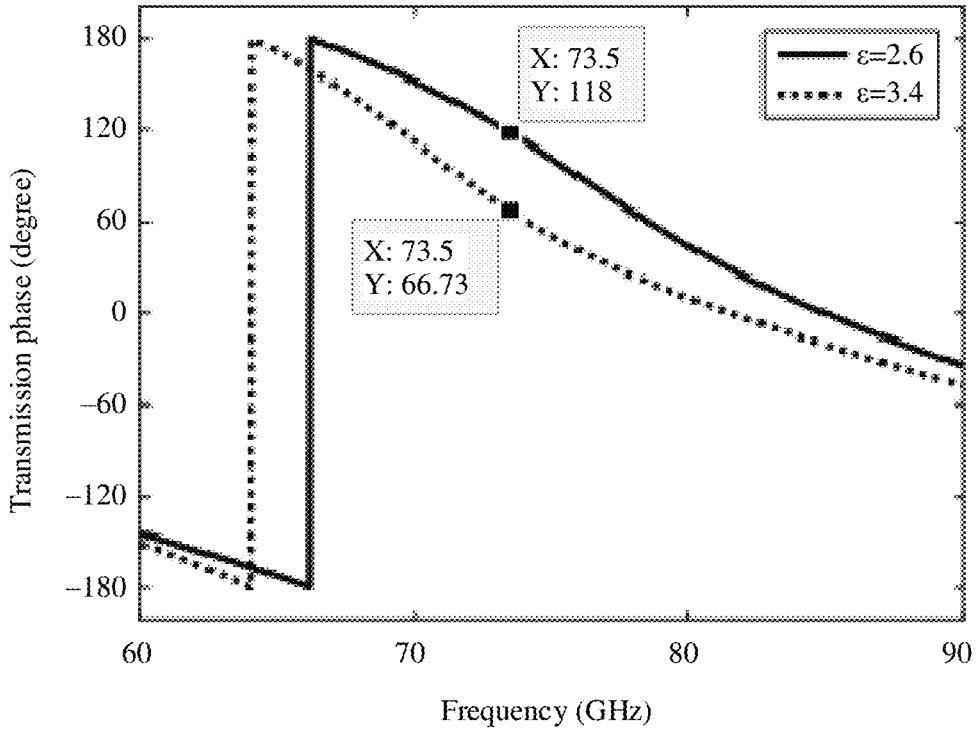
FIG. 6 is a curve chart of a relationship between a transmission phase of a liquid crystal metasurface array unit and a frequency under different liquid crystal dielectric constants according to at least one embodiment.

FIG. 6 is a curve chart of a relationship between a transmission phase of a liquid crystal metasurface array unit and a frequency under different liquid crystal dielectric constants according to at least one embodiment. In FIG. 6, a horizontal coordinate indicates a working frequency, and a vertical coordinate indicates a transmission phase. FIG. 6 shows two curves whose liquid crystal dielectric constants are 2.6 and 3.4. If the selected working frequency is 73.5 GHz, when the liquid crystal dielectric constant is 2.6, the transmission phase of the liquid crystal metasurface array unit is 118 degrees; and when the liquid crystal dielectric constant is 3.4, the transmission phase of the liquid crystal metasurface array unit is 66.73 degrees. Therefore, it can be learned that the transmission phase decreases by 6.4 degrees for every increase of 0.1 of the liquid crystal dielectric constant.

Under the lateral offsets Δd of different feed phase centers, the liquid crystal dielectric constants of the metasurface array units are obtained according to the simulation analysis.

Figure 7:
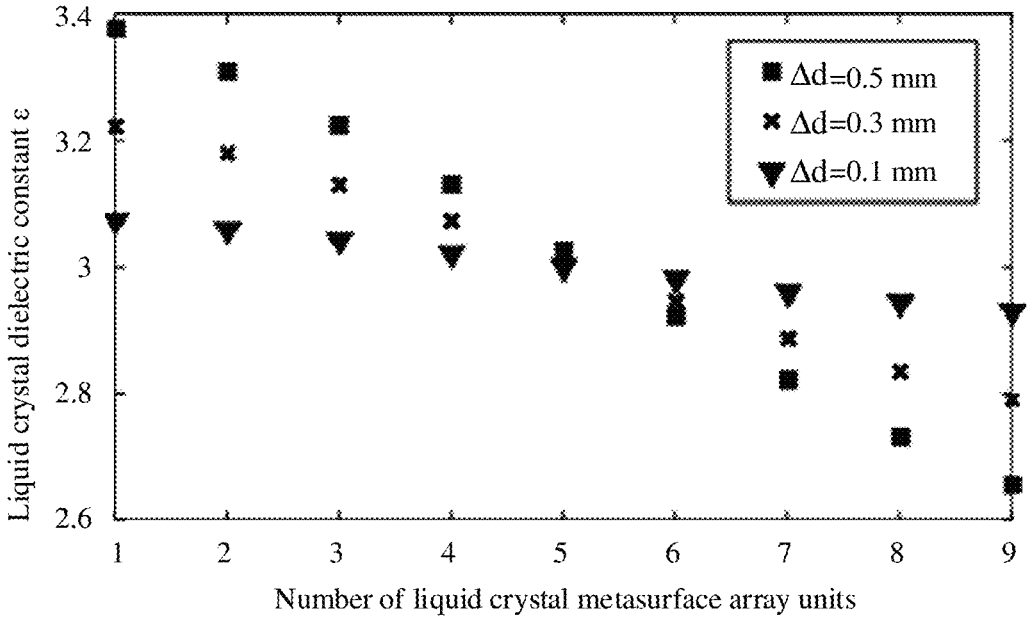
FIG. 7 is a diagram of a correspondence between a lateral offset Δd of a feed phase center and a liquid crystal dielectric constant of each liquid crystal metasurface array unit according to at least one embodiment.

FIG. 7 is a diagram of a correspondence between a lateral offset Δd of a feed phase center and a liquid crystal dielectric constant of each liquid crystal metasurface array unit according to at least one embodiment. In FIG. 7, a horizontal coordinate indicates a number of the liquid crystal metasurface array units, and a vertical coordinate indicates a liquid crystal dielectric constant. FIG. 7 shows corresponding liquid crystal dielectric constants of nine liquid crystal metasurface array units when Δd is 0.1, 0.3, or 0.5. When Δd is one of the values of 0.1, 0.3, or 0.5, the liquid crystal dielectric constants of the liquid crystal metasurface array units are different.

There is a fixed relationship between the liquid crystal dielectric constant and the liquid crystal bias voltage. For example, voltage bias values corresponding to different liquid crystal dielectric constants may be obtained through actual engineering testing with reference to the liquid crystal dielectric constant and a liquid crystal model. Alternatively, the liquid crystal voltage bias values corresponding to different liquid crystal dielectric constants may be obtained by looking up a table with reference to a specific liquid crystal model.

The liquid crystal metasurface array in at least one embodiment may be applied to a plurality of types of antennas, for example, a Cassegrain antenna, a reflector antenna, and a lens antenna.

Figure 8:
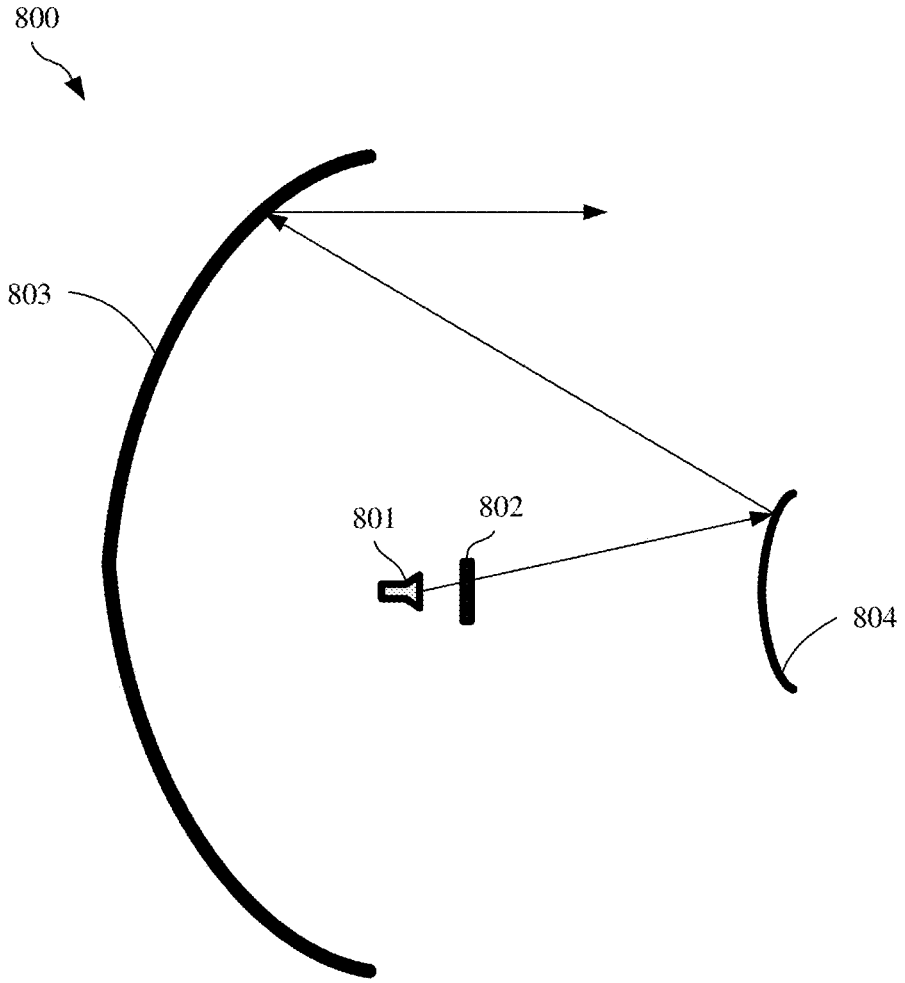
FIG. 8 is a schematic structural diagram of an antenna according to at least one embodiment.

FIG. 8 is a schematic structural diagram of an antenna according to at least one embodiment. As shown in FIG. 8, the antenna 800 is a Cassegrain antenna, and may include a feed 801, a liquid crystal metasurface array 802, and a beam transformation structure. The beam transformation structure includes a primary reflector 803 and a secondary reflector 804. The feed 801 and the liquid crystal metasurface array 802 are located between the primary reflector 803 and the secondary reflector 804. The liquid crystal metasurface array 802 includes M×N liquid crystal metasurface array units, and M and N are positive integers greater than or equal to 2. M may be equal or unequal to N. The antenna 800 may further include a liquid crystal bias control circuit (not shown in the figure), and may include a plurality of voltage control units, for example, M×N voltage control units. In this case, one voltage control unit may be electrically coupled to, and control a voltage bias value of, one liquid crystal metasurface array unit.

Figure 9:
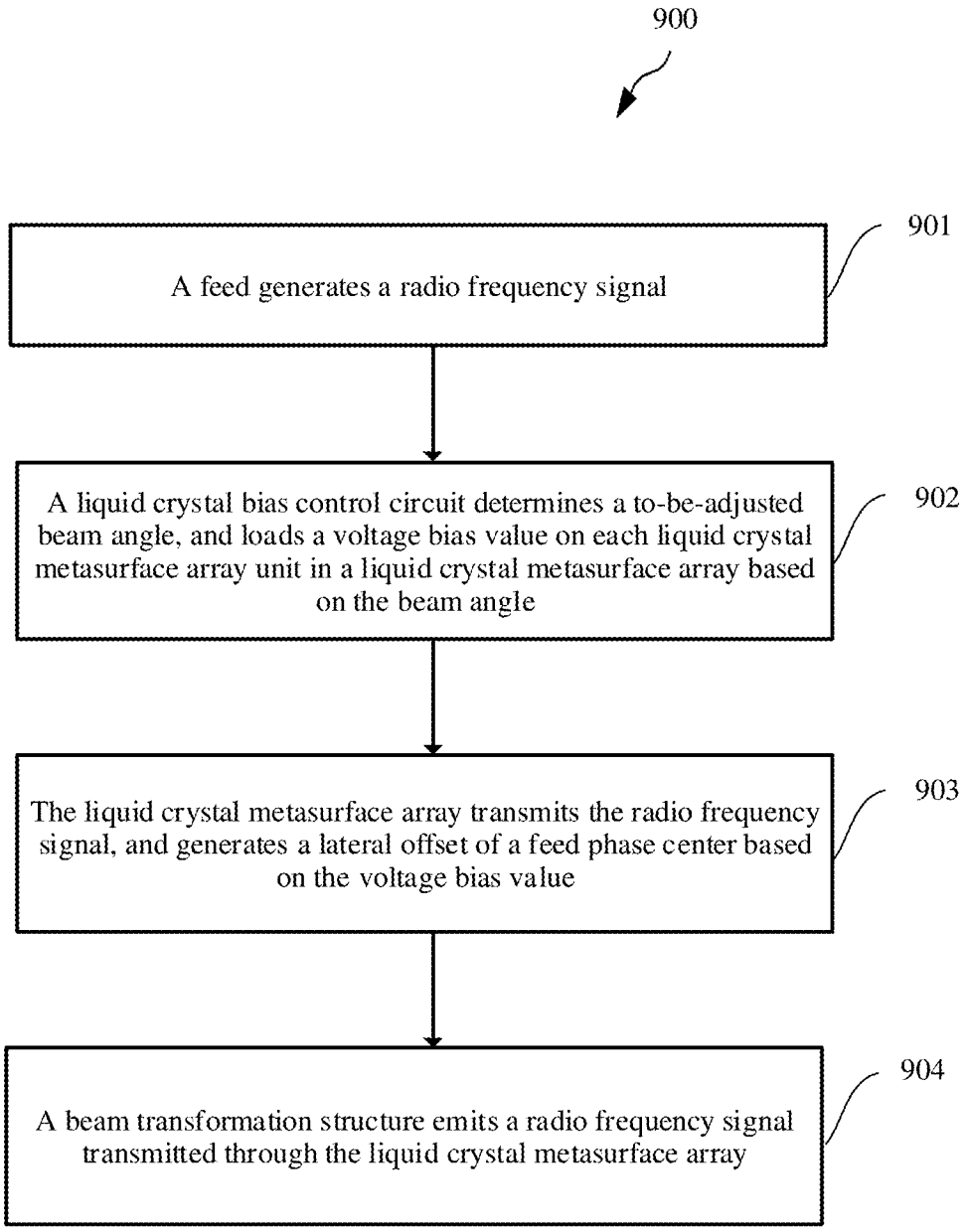
FIG. 9 is an example flowchart of a beam reconstruction method according to at least one embodiment.

When the antenna 800 is applied to the device at the transmitting end shown in FIG. 1, that is, when the antenna 800 is used as the transmitting antenna 103 of the microwave device 101 at the transmitting end in FIG. 1, a method 900 for beam reconstruction shown in FIG. 9 may be performed.

FIG. 9 is an example flowchart of a beam reconstruction method according to at least one embodiment. The method may include the following operations.

At operation 901, a feed generates a radio frequency signal.

An input port of the feed is configured to receive a radio frequency signal from the outdoor unit or the radio frequency module of the microwave device 101, and the radio frequency signal is transmitted to a radiation aperture of the feed through a waveguide tube. The radiation aperture of the feed may be a primary horn antenna that radiates a radio frequency signal towards a secondary reflector of a beam transformation structure. The radio frequency signal may be a microwave signal, that is, an electromagnetic wave of a specific frequency.

At operation 902, a liquid crystal bias control circuit determines a to-be-adjusted beam angle, and loads a voltage bias value on each liquid crystal metasurface array unit in the liquid crystal metasurface array based on the beam angle.

According to a calculation formula of an antenna scanning principle, a relationship between a deflection angle of an antenna beam and a lateral offset of a feed phase center may be expressed by using the following formula:

$$\alpha = \left[\frac{(4F/D)^2 + 0.36}{(4F/D)^2 + 0.1}\right]\tan^{-1}(\Delta d/F), \tag{3}$$

where

F is an equivalent focal length of the Cassegrain antenna, and D is an aperture of the Cassegrain antenna.

The deflection angle α of the antenna beam may be determined by a microwave device at a receiving end. For example, a primary feed and a secondary feed are disposed in a receiving antenna of the microwave device at the receiving end, and a plurality of (for example, four) secondary feeds are placed around the primary feed. When the beams are aligned, receiving powers of the secondary feeds are the same. When the beam is offset, receiving powers of the secondary feeds are different. The deflection angle $\alpha$ of the antenna beam may be calculated based on changes of the receiving power. After determining the deflection angle $\alpha$ of the antenna beam, the microwave device at the receiving end may notify the microwave device at the transmitting end of the deflection angle $\alpha$.

A deflection angle $\alpha$ of the antenna beam of a liquid crystal bias circuit at the receiving end and a to-be-adjusted beam angle may be two angles whose angle values are equal but directions are opposite. A voltage bias value of each liquid crystal metasurface array unit may be determined based on the to-be-adjusted beam angle or the deflection angle $\alpha$ of the antenna beam. There are a plurality of implementations for determining the voltage bias value, and three of the implementations are listed below:

First implementation: First, it can be learned from formula (3) that, the lateral offset $\Delta d$ of the feed phase center may be determined based on the deflection angle $\alpha$ of the antenna beam. Then, it can be learned from formula (2) that changes of a transmission phase $\Delta\varphi_n$ of each liquid crystal metasurface array unit may be determined according to $\Delta d$. Then, it can be learned from FIG. 6 that a dielectric constant of each liquid crystal metasurface array unit is determined according to $\Delta\varphi_n$. Finally, based on the dielectric constant of each liquid crystal metasurface array unit, the voltage bias value of each liquid crystal metasurface array unit is determined through engineering testing or table lookup.

Second implementation: First, it can be learned from formula (3) that, the lateral offset $\Delta d$ of the feed phase center may be determined based on the deflection angle $\alpha$ of the antenna beam. Then, it can be learned from FIG. 7 that a correspondence diagram or a correspondence table between $\Delta d$ and a dielectric constant of each liquid crystal metasurface array unit may be calculated and stored in advance. When the beam angle needs to be adjusted, the dielectric constant of each liquid crystal metasurface array unit may be learned according to $\Delta d$. Finally, based on the dielectric constant of each liquid crystal metasurface array unit, the voltage bias value of each liquid crystal metasurface array unit is determined through engineering testing or table lookup.

Third implementation: A correspondence between a deflection angle $\alpha$ of an antenna beam and a voltage bias value of each liquid crystal metasurface array unit may be calculated and stored in advance based on a deduction process in the first implementation. When the beam angle needs to be adjusted, the voltage bias value of each liquid crystal metasurface array unit may be learned according to $\alpha$. Finally, based on the dielectric constant of the liquid crystal metasurface array unit, the voltage bias value of each liquid crystal metasurface array unit is determined through engineering testing or table lookup.

At operation 903, the liquid crystal metasurface array transmits the radio frequency signal, and generates the lateral offset of the feed phase center based on the voltage bias value.

In at least one embodiment, the radio frequency signal emitted by the feed is transmitted through the liquid crystal metasurface array, and the liquid crystal dielectric constant is controlled by using the voltage bias value, to change the transmission phase of the liquid crystal metasurface array unit, and implement the lateral offset of the feed phase center. The voltage bias value loaded on each liquid crystal metasurface array unit can change the transmission phase of radio frequency signals transmitted through each liquid crystal metasurface array unit.

At operation 904, the beam transformation structure emits the radio frequency signal transmitted through the liquid crystal metasurface array.

The beam transformation structure in FIG. 8 includes a primary reflector and a secondary reflector. Radio frequency signals can be reflected on the primary reflector and the secondary reflector, and directional gain can be provided. The reflected radio frequency signals have certain directivity. The radio frequency signals generated by the feed are transmitted through the liquid crystal metasurface array, reflected by the secondary reflector, reflected by the primary reflector, and then transmitted in a certain direction in the air. After the beam angle is adjusted, the beam direction can be aligned with the receiving antenna at the receiving end.

In at least one embodiment, when a direction of the receive beam is not aligned with the antenna at the receiving end, the voltage bias value of the liquid crystal metasurface array unit of the antenna at the transmitting end may be adjusted, and the lateral offset of the feed phase center is generated based on the voltage bias value, to implement reconfiguration of the feed phase center and reconfiguration of an antenna beam, thereby implementing beam alignment. According to the foregoing method, at least one embodiment implements a beam reconfigurable antenna with low costs and low complexity, to resolve a problem that the antenna is sensitive to shaking.

Figure 10:
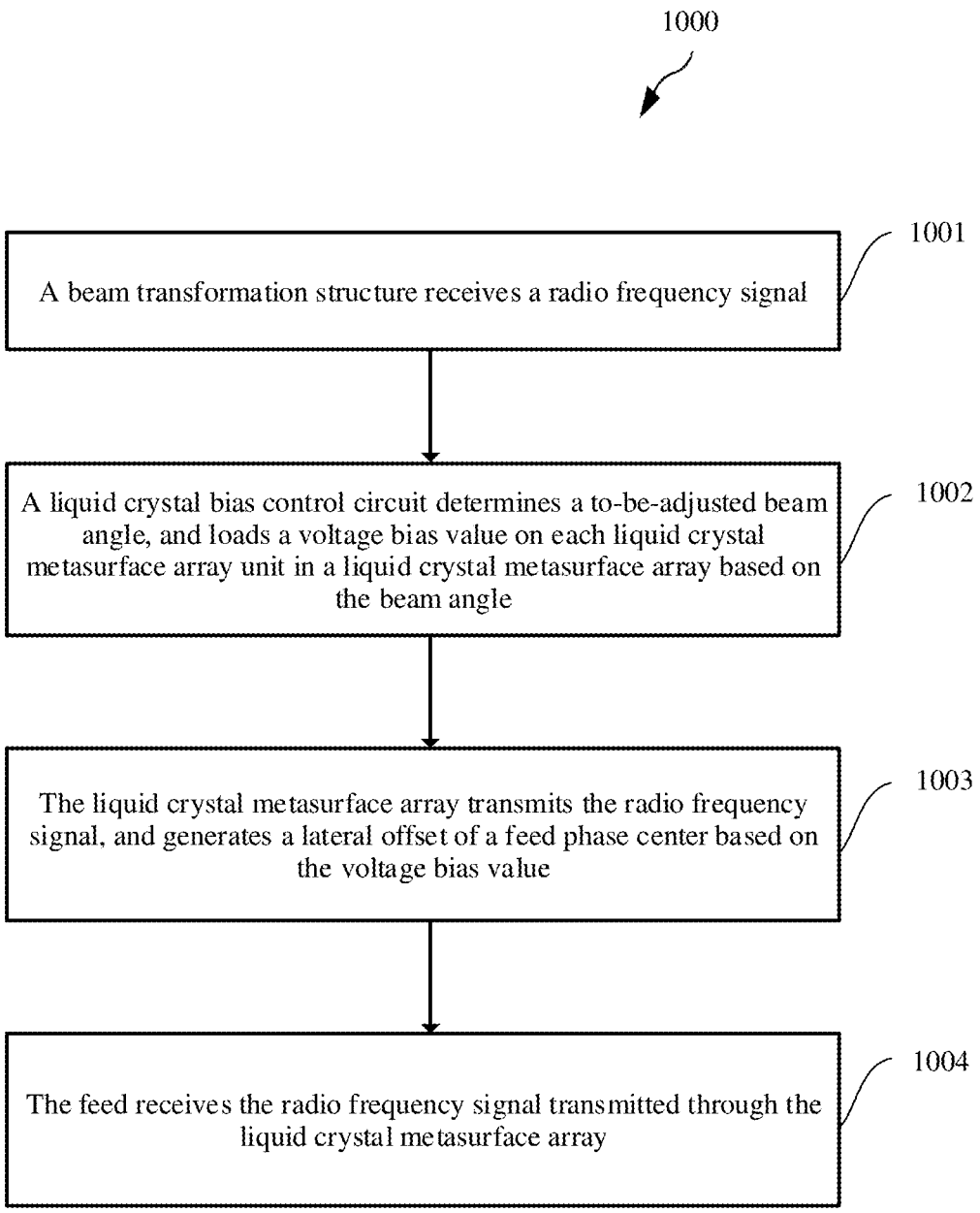
FIG. 10 is an example flowchart of a beam reconstruction method according to at least one embodiment.

When the antenna 800 is applied to the device at the receiving end shown in FIG. 1, that is, when the antenna 800 is used as the receiving antenna 104 of the microwave device 102 at the receiving end in FIG. 1, a method 1000 for beam reconstruction shown in FIG. 10 may be performed.

FIG. 10 is an example flowchart of a beam reconstruction method according to at least one embodiment. The method may include the following operations.

At operation 1001, a beam transformation structure receives a radio frequency signal.

The beam transformation structure in FIG. 8 includes a primary reflector and a secondary reflector. The primary reflector and the secondary reflector reflect radio frequency signals received in a relatively large area and focus the signals on the radiation aperture of the feed. The radio frequency signal is first received by the primary reflector, reflected by the primary reflector to the secondary reflector, reflected by the secondary reflector, transmitted through the liquid crystal metasurface array, and received by the feed. In other words, the beam transformation structure directs the received radio frequency signal through the liquid crystal metasurface array to the feed.

At operation 1002, a liquid crystal bias control circuit determines a to-be-adjusted beam angle, and loads a voltage bias value on each liquid crystal metasurface array unit in the liquid crystal metasurface array based on the beam angle.

The deflection angle $\alpha$ of the antenna beam may be determined by a microwave device at a receiving end. For example, the deflection angle $\alpha$ is detected by setting a primary feed and a secondary feed. For a specific implementation, refer to operation 902. Details are not described herein again. For determining the voltage bias values of the liquid crystal metasurface array units respectively based on the to-be-adjusted beam angle or the deflection angle $\alpha$ of the antenna beam, refer to the implementation of operation 902. Details are not described herein again.

At operation 1003, the liquid crystal metasurface array transmits the radio frequency signal, and generates a lateral offset of a feed phase center based on the voltage bias value.

In at least one embodiment, the radio frequency signal received by the beam transformation structure is transmitted through the liquid crystal metasurface array, and the liquid crystal dielectric constant is controlled by using the voltage bias value, to change the transmission phase of the liquid crystal metasurface array unit, and implement the lateral offset of the feed phase center. The voltage bias value loaded on each liquid crystal metasurface array unit can change the transmission phase of radio frequency signals transmitted through each liquid crystal metasurface array unit. Optionally, transmission phases generated by the radio frequency signal in the liquid crystal metasurface array units are different.

At operation 1004, the feed receives the radio frequency signal transmitted through the liquid crystal metasurface array.

The radio frequency signal received by the feed may be sent to the outdoor unit or the radio frequency module of the microwave device 102. After the beam angle is adjusted, the beam direction can be aligned with the receiving antenna at the receiving end.

In at least one embodiment, when a direction of the receive beam is not aligned with the antenna at the receiving end, the voltage bias value of the liquid crystal metasurface array unit of the antenna at the receiving end may be adjusted, and the lateral offset of the feed phase center is generated based on the voltage bias value, to implement reconfiguration of the feed phase center and reconfiguration of an antenna beam, thereby implementing beam alignment. According to the foregoing method, at least one embodiment implements a beam reconfigurable antenna with low costs and low complexity, to resolve a problem that the antenna is sensitive to shaking.

Figure 11:
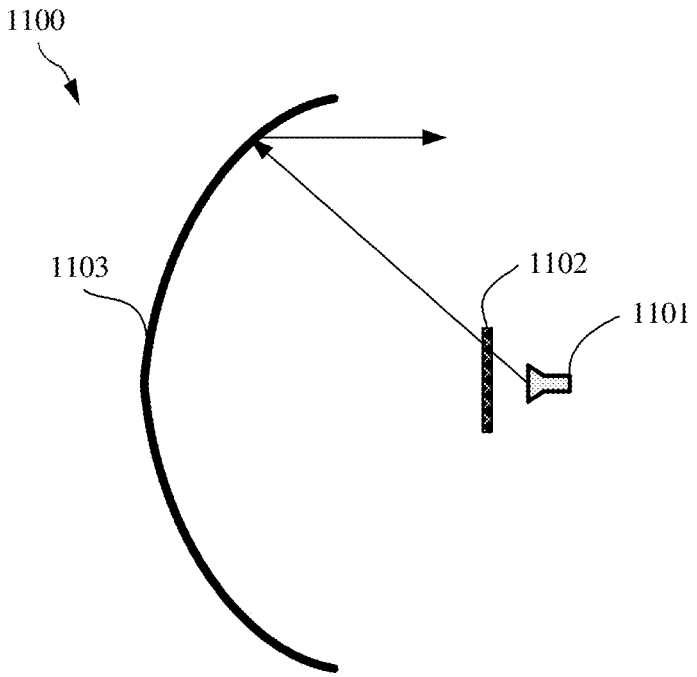
FIG. 11 is a schematic structural diagram of an antenna according to at least one embodiment.

FIG. 11 is a schematic structural diagram of an antenna according to at least one embodiment. As shown in FIG. 11, the antenna 1100 is a single reflector antenna (for example, a paraboloidal antenna), and may include a feed 1101, a liquid crystal metasurface array 1102, and a reflector 1103. The liquid crystal metasurface array 1102 is located between the feed 1101 and the reflector 1103. The liquid crystal metasurface array includes M×N liquid crystal metasurface array units, and M and N are positive integers greater than or equal to 2. The antenna 1100 may further include a liquid crystal bias control circuit (not shown in the figure), and may include a plurality of voltage control units, for example, M×N voltage control units. In this case, one voltage control unit may control a voltage bias value of one liquid crystal metasurface array unit. The antenna shown in FIG. 11 may be used as a beam reconfigurable antenna. A principle of beam reconstruction is similar to that of the antenna shown in FIG. 8, i.e., a voltage bias value of a liquid crystal metasurface array unit of the antenna is adjusted, and a lateral offset of a feed phase center is generated based on the voltage bias value, to implement reconfiguration of the feed phase center and reconfiguration of an antenna beam, thereby implementing beam alignment. The antenna shown in FIG. 11 may perform the method shown in FIG. 9 or FIG. 10. Details are not described herein again. According to the foregoing method, at least one embodiment implements a beam reconfigurable antenna with low costs and low complexity, to resolve a problem that the antenna is sensitive to shaking.

Figure 12:
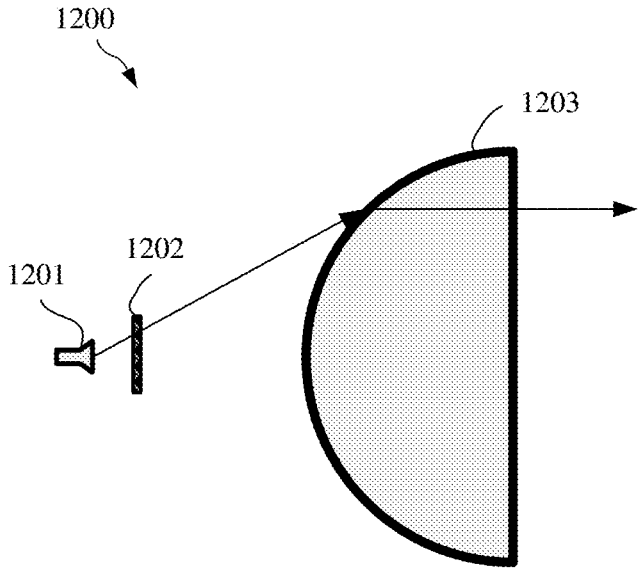
FIG. 12 is a schematic structural diagram of an antenna according to at least one embodiment.

FIG. 12 is a schematic structural diagram of an antenna according to at least one embodiment. As shown in FIG. 12, the antenna 1200 is a lens antenna, and may include a feed 1201, a liquid crystal metasurface array 1202, and a lens 1203. The liquid crystal metasurface array 1202 is located between the feed 1201 and the lens 1203. The liquid crystal metasurface array includes M×N liquid crystal metasurface array units, and M and N are positive integers greater than or equal to 2. The antenna 1200 may further include a liquid crystal bias control circuit (not shown in the figure), and may include a plurality of voltage control units, for example, M×N voltage control units. In this case, one voltage control unit may control a voltage bias value of one liquid crystal metasurface array unit. The antenna shown in FIG. 12 may be used as a beam reconfigurable antenna. A principle of beam reconstruction is similar to that of the antenna shown in FIG. 8, i.e., a voltage bias value of a liquid crystal metasurface array unit of the antenna is adjusted, and a lateral offset of a feed phase center is generated based on the voltage bias value, to implement reconfiguration of the feed phase center and reconfiguration of an antenna beam, thereby implementing beam alignment. The antenna shown in FIG. 12 may perform the method shown in FIG. 9 or FIG. 10. Details are not described herein again. According to the foregoing method, at least one embodiment implements a beam reconfigurable antenna with low costs and low complexity, to resolve a problem that the antenna is sensitive to shaking.

Figure 13:
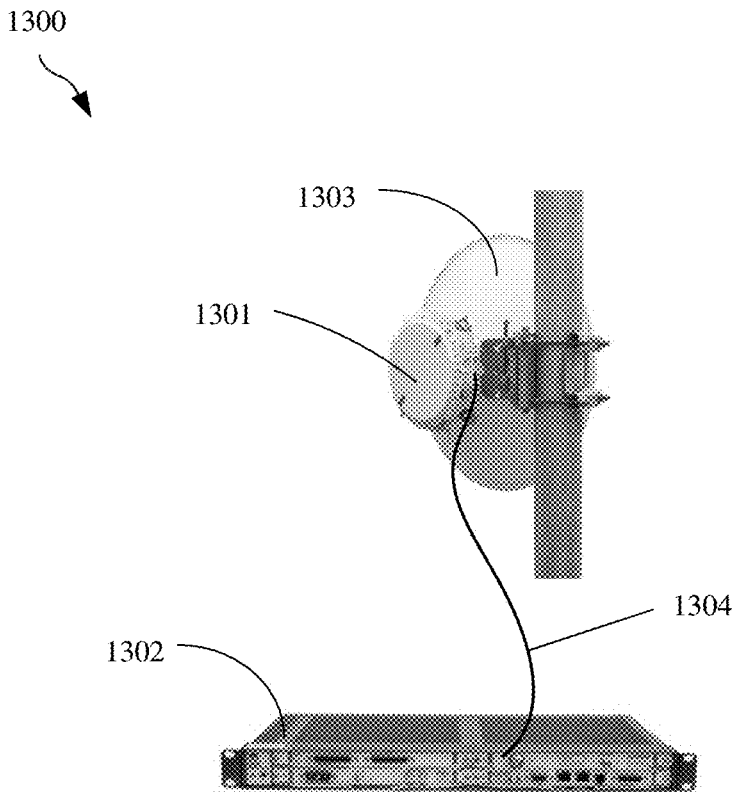
FIG. 13 is a schematic structural diagram of a microwave device according to at least one embodiment.

FIG. 13 is a schematic structural diagram of a microwave device according to at least one embodiment. As shown in FIG. 13, the microwave device 1300 may include an outdoor unit (outdoor unit, ODU, also referred to as outdoor device, or first/second device) 1301, an indoor unit (indoor unit, IDU, also referred to as indoor device, or second/first device) 1302, an antenna 1303, and an intermediate frequency cable 1304. The ODU 1301 and the IDU 1302 may be connected through the intermediate frequency cable 1304, and the ODU may be connected to the antenna through a feeding waveguide.

The ODU 1301 may include an intermediate frequency module, a sending module, a receiving module, a multiplexer, a duplexer, and the like. The ODU 1301 performs conversion between an intermediate frequency analog signal and a radio frequency signal. In a transmitting direction, the ODU 1301 performs up-conversion and amplification on the intermediate frequency analog signal from the IDU 1302, converts the intermediate frequency analog signal into a radio frequency signal of a specific frequency, and sends the radio frequency signal to the antenna 1303. In a receiving direction, the ODU 1301 performs down-conversion and amplification on the radio frequency signal received from the antenna 1303, converts the radio frequency signal into an intermediate frequency analog signal, and sends the intermediate frequency analog signal to the IDU 1302.

The IDU 1302 may include a board such as a system control, switching, and timing board, an intermediate frequency board, or a service board, and may provide a plurality of service interfaces such as a gigabit Ethernet (Gigabit Ethernet, GE) service, a synchronous transfer mode-1 (synchronous transfer module-1, STM-1) service, and an E1 service. The IDU 1302 mainly provides services such as processing a baseband signal and performing conversion between a baseband signal and an intermediate frequency analog signal. In a transmitting direction, the IDU 1302 modulates a baseband digital signal into an intermediate frequency analog signal. In a receiving direction, the IDU 1302 demodulates and digitizes the received intermediate frequency analog signal and decomposes the intermediate frequency analog signal into baseband digital signals.

The antenna 1303 may be any one of the antennas shown in FIG. 8, FIG. 11, and FIG. 12 in some embodiments. The antenna 1303 mainly provides a directional sending and receiving function for a radio frequency signal, and implements conversion between a radio frequency signal generated or received by the ODU 1301 and a radio frequency signal in atmospheric space. In a transmitting direction, the antenna 1303 converts a radio frequency signal output by the ODU 1301 into a directional radio frequency signal, and radiates the directional radio frequency signal to space. In a receiving direction, the antenna 1303 receives the radio frequency signal in the space, focuses the radio frequency signal, and transmits the radio frequency signal to the ODU 1301. The beam reconstruction method provided in at least one embodiment may be applied to the antenna in the transmitting direction, or may be applied to the antenna in the receiving direction. For example, in the transmitting direction, the antenna 1303 receives a radio frequency signal from the ODU 1301; determines a to-be-adjusted beam angle; changes a voltage bias value of each liquid crystal metasurface array unit in a liquid crystal metasurface array based on the beam angle, where a lateral offset of a feed phase center is generated based on the voltage bias value after the radio frequency signal is transmitted through the liquid crystal metasurface array; and emits the radio frequency signal transmitted through the liquid crystal metasurface array. In the receiving direction, the antenna 1303 receives a radio frequency signal radiated in the space; determines a to-be-adjusted beam angle; loads a voltage bias value on each liquid crystal metasurface array unit in a liquid crystal metasurface array based on the to-be-adjusted beam angle, where a lateral offset of a feed phase center is generated based on the voltage bias value after the radio frequency signal is transmitted through the liquid crystal metasurface array; and receives the radio frequency signal transmitted through the liquid crystal metasurface array.

The microwave device 1300 may be a split-structured microwave device, that is, the IDU 1302 is placed indoors, and the ODU 1301 and the antenna 1303 are assembled and placed outdoors. The microwave device 1300 may alternatively be a full-outdoor microwave device, that is, the ODU 1301, the IDU 1302, and the antenna 1303 are all placed outdoors. The microwave device 1300 may alternatively be a full-indoor microwave device, that is, the ODU 1301 and the IDU 1302 are placed indoors, and the antenna 1303 is placed outdoors. The ODU 1301 may also be referred to as a radio frequency module, and the IDU 1302 may also be referred to as a baseband.

When the beam reconfigurable antenna provided in at least one embodiment is applied to a microwave device, a capability of the device against shaking can be improved, and complexity and costs of the device can be reduced.

In the foregoing embodiments, at least one or some operations may be implemented by using software while at least another or some other operations may be implemented by using hardware. Alternatively, all operations may be implemented by using hardware. In an example, in operation 902 or operation 1002, program code may be loaded on the liquid crystal bias control circuit for calculating the voltage bias value, and a hardware circuit on the liquid crystal bias control circuit loads or adjusts the voltage bias value based on a calculation result. In another example, a correspondence table between a deflection angle $\alpha$ of an antenna beam and a voltage bias value of each liquid crystal metasurface array unit may be stored in a storage element on the liquid crystal bias control circuit, and a hardware circuit on the liquid crystal bias control circuit loads or adjusts the voltage bias value based on a result of the table lookup. In another example, calculation of the voltage bias value or storage of the correspondence table may also be implemented in another module, for example, implemented in an outdoor unit of the microwave device, and the outdoor unit notifies the liquid crystal bias control circuit of the voltage bias value obtained through calculation or table lookup. The program code in at least one embodiment may be implemented by using a hardware description language, for example, a Verilog language. The program code may be loaded in a programmable logic device, such as a field programmable gate array (programmable gate array, FPGA) or a complex programmable logic device (CPLD, complex programmable logic device). When the program code runs in the programmable logic device, all or some of the procedures or functions according to some embodiments are generated.

Examples of a control circuit and/or a hardware circuit include, but are not limited to, a processor (such as a central processing unit or CPU), an application-specific integrated circuit (ASIC), or the like. Examples of a storage element and/or a non-transitory computer-readable storage medium include, but are not limited to, electronic, magnetic, optical, electromagnetic, infrared, and/or a semiconductor system (or apparatus or device), such as, a semiconductor or solid-state memory, a magnetic tape, a removable computer diskette, a random access memory (RAM), a read-only memory (ROM), a flash memory, a rigid magnetic disk, an optical disk, a compact disk-read only memory (CD-ROM), a compact disk-read/write (CD-R/W), a digital video disc (DVD), or the like.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An antenna, comprising:

a feed;

a liquid crystal metasurface array;

a liquid crystal bias control circuit; and a beam transformation structure, wherein the liquid crystal metasurface array comprises a plurality of liquid crystal metasurface array units, the feed is configured to generate or receive a radio frequency signal, the liquid crystal bias control circuit is configured to:

determine a to-be-adjusted beam angle, and load a voltage bias value on each liquid crystal metasurface array unit in the liquid crystal metasurface array based on the beam angle, the liquid crystal metasurface array is configured to:

transmit the radio frequency signal, and generate a lateral offset of a feed phase center based on the voltage bias value, and the beam transformation structure is configured to emit the radio frequency signal generated from the feed and then transmitted through the liquid crystal metasurface array, or receive the radio frequency signal and then direct the radio frequency signal through the liquid crystal metasurface array to the feed.

2. The antenna according to claim 1, wherein the liquid crystal bias control circuit is configured to change, based on the loaded voltage bias value, a transmission phase generated when the radio frequency signal is transmitted through each liquid crystal metasurface array unit in the liquid crystal metasurface array.

3. The antenna according to claim 2, wherein the liquid crystal bias control circuit is configured to, for changing the transmission phase, change a dielectric constant of each liquid crystal metasurface array unit in the liquid crystal metasurface array based on the loaded voltage bias value.

4. The antenna according to claim 1, wherein the liquid crystal bias control circuit is further configured to determine the lateral offset of the feed phase center based on the to-be-adjusted beam angle.

5. The antenna according to claim 1, wherein the beam transformation structure comprises a primary reflector and a secondary reflector, the feed and the liquid crystal metasurface array are located between the primary reflector and the secondary reflector, and the liquid crystal metasurface array is located between the feed and the secondary reflector.

6. The antenna according to claim 1, wherein the beam transformation structure comprises a lens, and the liquid crystal metasurface array is located between the feed and the lens.

7. The antenna according to claim 1, wherein the beam transformation structure comprises a reflector, and the liquid crystal metasurface array is located between the feed and the reflector.

8. The antenna according to claim 1, wherein the antenna is a transmitting antenna configured to be in communication with a receiving antenna, and the liquid crystal bias control circuit is configured to determine the to-be-adjusted beam angle to have a same angle value as, but with a direction opposite to, a deflection angle of an antenna beam received at the receiving antenna from the transmitting antenna.

9. The antenna according to claim 8, wherein the antenna is a receiving antenna configured to be in communication with a transmitting antenna, and to detect a deflection angle of an antenna beam received at the receiving antenna from the transmitting antenna, and the liquid crystal bias control circuit is configured to determine the to-be-adjusted beam angle to have a same angle value as, but with a direction opposite to, the deflection angle.

10. The antenna according to claim 1, wherein the lateral offset of the feed phase center is a distance between the feed phase center and an equivalent phase center of the feed, and the distance is in a plane parallel to the liquid crystal metasurface array.

11. The antenna according to claim 1, wherein the liquid crystal bias control circuit is configured to determine the lateral offset of the feed phase center based on the to-be-adjusted beam angle or a deflection angle of the antenna beam, determine, for each liquid crystal metasurface array unit in the liquid crystal metasurface array, a different dielectric constant based on the lateral offset of the feed phase center, and determine the voltage bias value of each liquid crystal metasurface array unit in the liquid crystal metasurface array, based on the dielectric constant of said each liquid crystal metasurface array unit, wherein the to-be-adjusted beam angle has a same angle value as, but with a direction opposite to, the deflection angle.

12. The antenna according to claim 1, wherein the liquid crystal bias control circuit comprises a previously stored table including, for each of a plurality of different values of the lateral offset, a set of different dielectric constants each for a corresponding liquid crystal metasurface array unit in the liquid crystal metasurface array.

13. The antenna according to claim 1, wherein the liquid crystal bias control circuit comprises a previously stored table including, for each of a plurality of different values of a deflection angle, a set of voltage bias values each for a corresponding liquid crystal metasurface array unit in the liquid crystal metasurface array, and the deflection angle is of an antenna beam at a receiving end, and is equal, but with an opposite direction, to the to-be-adjusted beam angle.

14. A beam reconstruction method for an antenna, wherein the antenna comprises:

a feed;

a liquid crystal metasurface array;

a liquid crystal bias control circuit; and a beam transformation structure, wherein the liquid crystal metasurface array comprises a plurality of liquid crystal metasurface array units, the feed is configured to generate or receive a radio frequency signal, the liquid crystal bias control circuit is configured to:

determine a to-be-adjusted beam angle, and load a voltage bias value on each liquid crystal metasurface array unit in the liquid crystal metasurface array based on the beam angle, the liquid crystal metasurface array is configured to:

transmit the radio frequency signal, and generate a lateral offset of a feed phase center based on the voltage bias value, and the beam transformation structure is configured to emit the radio frequency signal generated from the feed and then transmitted through the liquid crystal metasurface array, or receive the radio frequency signal and then direct the radio frequency signal through the liquid crystal metasurface array to the feed, the method comprises:

generating or receiving, by the feed, the radio frequency signal;

determining, by the liquid crystal bias control circuit, the to-be-adjusted beam angle;

loading, by the liquid crystal bias control circuit, the voltage bias value on each liquid crystal metasurface array unit in the liquid crystal metasurface array based on the beam angle, wherein the lateral offset of the feed phase center is generated based on the voltage bias value after the radio frequency signal is transmitted through the liquid crystal metasurface array; and emitting the generated radio frequency signal transmitted through the liquid crystal metasurface array, or directing the received radio frequency signal through the liquid crystal metasurface array to the feed.

15. A microwave device, comprising: a first device, a second device, and an antenna, wherein the first device is configured to perform a first conversion between a baseband digital signal and an intermediate frequency analog signal, the second device is coupled to the first device, and configured to perform a second conversion between the intermediate frequency analog signal and a radio frequency signal, and the antenna is coupled to the second device, and comprises:

a feed;

a liquid crystal metasurface array;

a liquid crystal bias control circuit; and a beam transformation structure, wherein the liquid crystal metasurface array comprises a plurality of liquid crystal metasurface array units, the feed is configured to generate or receive a radio frequency signal, the liquid crystal bias control circuit is configured to:

determine a to-be-adjusted beam angle, and load a voltage bias value on each liquid crystal metasurface array unit in the liquid crystal metasurface array based on the beam angle, the liquid crystal metasurface array is configured to:

transmit the radio frequency signal, and generate a lateral offset of a feed phase center based on the voltage bias value, and the beam transformation structure is configured to emit the radio frequency signal generated from the feed and then transmitted through the liquid crystal metasurface array, or receive the radio frequency signal and then direct the radio frequency signal through the liquid crystal metasurface array to the feed.

16. The microwave device according to claim 15, wherein the antenna is configured to change, based on the loaded voltage bias value, a transmission phase generated when the radio frequency signal is transmitted through each liquid crystal metasurface array unit in the liquid crystal metasurface array.

17. The microwave device according to claim 16, wherein the antenna is configured to, for changing the transmission phase, change a dielectric constant of each liquid crystal metasurface array unit in the liquid crystal metasurface array based on the loaded voltage bias value.

18. The microwave device according to claim 15, wherein the antenna is further configured to determine the lateral offset of the feed phase center based on the to-be-adjusted beam angle.

19. The microwave device according to claim 18, wherein the antenna is further configured to determine the dielectric constant of each liquid crystal metasurface array unit in the liquid crystal metasurface array based on the lateral offset of the feed phase center.

20. The microwave device according to claim 19, wherein the antenna is further configured to determine the voltage bias value loaded on each liquid crystal metasurface array unit in the liquid crystal metasurface array, based on the dielectric constant of said each liquid crystal metasurface array unit.

* * * * *